US006029749A

United States Patent [19]

Reilly et al.

[11] Patent Number: 6,029,749

[45] Date of Patent: Feb. 29, 2000

[54] ACTUATOR FOR CHECK VALVE

[75] Inventors: William Joseph Reilly, Langhorne; Philip M. Thomas, Bethlehem, both of Pa.

[73] Assignee: Victaulic Fire Safety Company, L.L.C., Easton, Pa.

[21] Appl. No.: 09/080,879

[22] Filed: May 18, 1998

[51] Int. Cl.[7] ..... A62C 35/00; A62C 37/08

[52] U.S. Cl. ..... 169/17; 169/22

[58] Field of Search ..... 169/17, 18, 42, 169/19, 22; 137/516.29; 251/61.2

[56] References Cited

U.S. PATENT DOCUMENTS

| | | | |
|---|---|---|---|
| 1,861,777 | 6/1932 | Benson | 169/17 |
| 3,785,440 | 1/1974 | Shea | 169/17 |
| 4,105,076 | 8/1978 | Simons et al. | 169/42 |
| 4,286,668 | 9/1981 | McCormick | 169/22 |
| 4,615,353 | 10/1986 | McKee | 251/61.2 |
| 4,854,342 | 8/1989 | Polan | 137/516.29 |
| 5,294,090 | 3/1994 | Winnike | 251/61.2 |

*Primary Examiner*—Andres Kashnikow
*Assistant Examiner*—David Hwu
*Attorney, Agent, or Firm*—Abelman, Frayne & Schwab

[57] ABSTRACT

An actuator is provided for a check valve, having particular utility in a dry fire control system. The check valve is responsive to a drop in the system air pressure occasioned by opening of one or more sprinkler heads in the fire control system. The movement of the actuator to its open position, establishes a water drain line therethrough, while advantageously also opening a previously sealed outlet for the pressurized air within the actuator. The actuator may respond to either the magnitude of system air pressure drop, or the rate of system air pressure drop.

21 Claims, 4 Drawing Sheets

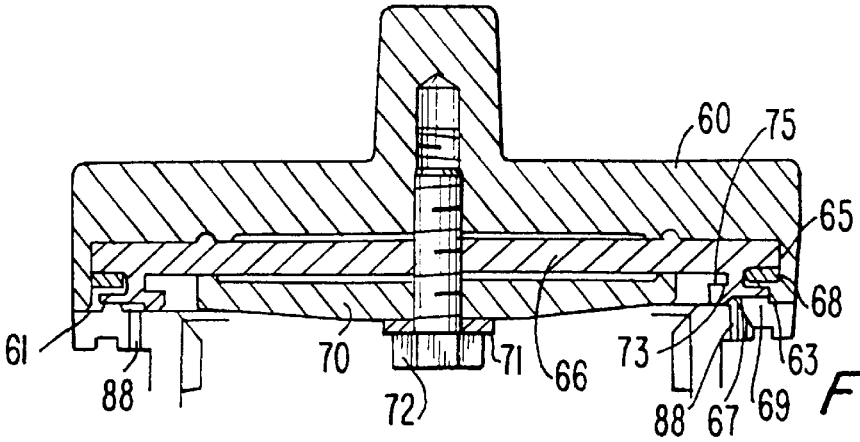
FIG. 3
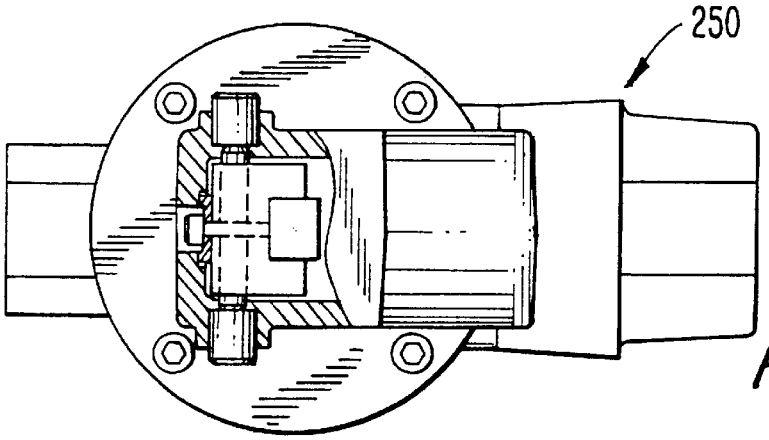
FIG. 7
FIG. 6
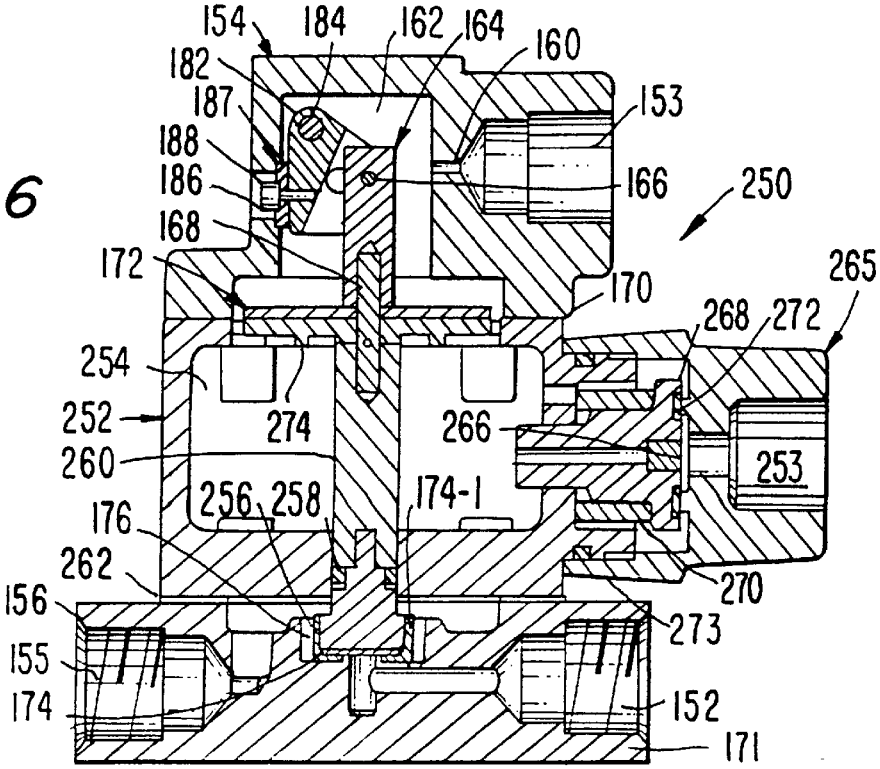

ACTUATOR FOR CHECK VALVE

FIELD OF INVENTION

The present invention relates to an actuator for a check valve intended for use in conjunction with a fire protection system. The fire protection system includes a plurality of individual sprinklers which are normally isolated from the pressurized water source by the check valve. The actuator valve of the present invention is particularly applicable for use in a dry type fire control sprinkler systems, in which the piping between the pressurized water source and individual sprinkler heads is normally void of water.

BACKGROUND OF THE INVENTION

Fire control sprinkler systems generally include a plurality of individual sprinkler heads which are usually ceiling mounted about the area to be protected. The sprinkler heads are normally maintained in a closed condition and include a thermally responsive sensing member to determine when a fire condition has occurred. Upon actuation of the thermally responsive member the sprinkler head is opened, permitting pressurized water at each of the individual sprinkler heads to freely flow therethrough for extinguishing the fire. The individual sprinkler heads are spaced apart from each other, by distances determined by the type of protection they are intended to provide (e.g. light or ordinary hazard conditions) and the ratings of the individual sprinklers, as determined by industry accepted rating agencies such as Underwriters Laboratories, Inc., Factory Mutual Research Corp. and/or the National Fire Protection Association. It should be well appreciated that once the sprinkler heads have been thermally activated there should be minimal delay for the water flow through the sprinkler head at its maximum intended volume.

In order to minimize the delay between thermal actuation and proper dispensing of water by the sprinkler head, the piping that connects the sprinkler heads to the water source is, in many instances at all times filled with water. This is known as a wet system, with the water being immediately available at the sprinkler head upon its thermal actuation. However, there are many situations in which the sprinkler system is installed in an unheated area, such as warehouses. In those situations, if a wet system is used, and in particular since the water is not flowing within the piping system over long periods of time, there is a danger of the water within the pipes freezing. This will not only deleteriously affect the operation of the sprinkler system, should the sprinkler heads be thermally actuated while there may be ice blockage within the pipes, but such freezing, if extensive, can result in the bursting of the pipes, thereby destroying the sprinkler system. Accordingly, in those situations it is the conventional practice to have the piping devoid of any water during its non-activated condition. This is known as a dry fire protection system.

While all fire protection sprinkler systems generally include a check valve for isolating the sprinkler system piping from the pressurized water source during the non-activated condition, the design of such check valves for a dry type fire control sprinkler system has presented various problems. The check valve which is the subject of U.S. patent application Ser. No. 09/080,879, filed on even date herewith in the name of William J. Reilly and entitled Low Differential Check Valve for Sprinkler System provides a particularly favorable solution. The check valve, which is interposed between the system piping and pressurized water source, includes a clapper, which when it is in its closed operative condition prevents the flow of the pressurized water into the sprinkler system piping. The sprinkler piping in the dry fire protection system will include air or some other inert gas (e.g. nitrogen) under pressure. The pressurized air, which is present within the sprinkler system piping, is also presented to the check valve. Should one or more of the sprinkler heads be thermally activated to its open condition, the pressure of the air within the sprinkler system piping and check valve will then drop. The check valve must be appropriately responsive to this drop in pressure, normally in opposition to the system water pressure also present in the check valve, to move the clapper to its open condition. When this occurs, it is desirable to have a rapid expulsion of the pressurized air within the check valve and the sprinkler system piping, to permit the rapid flow of the pressurized water through the open check valve, into the sprinkler system piping, and through the individual sprinkler heads to rapidly extinguish the fire.

The check valves intended for dry type fire control sprinkler systems have typically controlled the clapper movement by the water and the air pressure applied to its opposite sides. Such fire check valves include an air seal which opposes the pressurized water seal. To appropriately apply the system air pressure over the surface of the clapper air seal, a priming water level had oftentimes been maintained within the check valves prior to the check valve of aforementioned Serial No. During normal conditions, when no sprinkler heads have been activated, the two seals will be an equilibrium, thereby maintaining the clapper in its closed condition.

In order to increase the speed of check valve operation upon a drop off of the system air pressure, occasioned by the activation of one or more sprinkler heads, the system air pressure had normally previously been applied to the clapper air seal over a substantially greater area then the water pressure is applied to the clapper water seal. This is known as a high differential type check valve. A problem of such valves is that should there then be a reduction in the system water pressure after the clapper has opened, and particularly since the pressure against the opposite (air) side of the clapper has been increased with the column of water that has flowed therethrough, there is a tendency of the clapper to reclose. Since the pressure applied against the air seal of the clapper will now be increased by the column of water extending upwards from the reclosed check valve, a greater water pressure would now be required to move the clapper to its open condition. Such disadvantageous reclosure, is referred to as a water columning effect. This could result in failure of the check valve to subsequently open should one or more of the sprinkler heads be thermally activated.

In order to avoid the reclosure of the clapper prior to aforementioned Ser. No. 09/080,879, dry system check valves have generally been provided with a mechanical latch to maintain the clapper in its open condition once it has been activated. The inclusion of such a mechanical latch, while serving to prevent reclosure, disadvantageously requires the entire sprinkler system to be shut down and the interior of the high differential type actuator accessed to release the latch and reclose the clapper after the fire has been extinguished. Thus such prior dry system check valves have typically required the main supply of water to be shut off, the water drained from the system, and then the high differential check valve opened to manually unlatch and reset the clapper. Recognizing the disadvantage of having to manually access the interior of the check valve a mechanism is shown in U.S. Pat. Nos. 5,295,503 and 5,439,028 which includes a reset linkage mechanism attached to the check valve, and actuated by the rotation of an externally accessible handle. As can be well appreciated such a mechanism adds to the size, cost and complexity of the check valve.

The check valve of the aforementioned Ser. No. 09/080,879, which is intended to operate in conjunction with the actuator of the invention includes flexible air and water pressure seals for the clapper. These seals are in radial proximity, such that there is a minimal differential area for the application of the air and water pressure to the clapper. This is referred to as a low differential check valve. The clapper is maintained in its closed operative condition by a latch which has a latch release mechanism. The latch release mechanism of the differential check valve is operated by a plunger which is maintained in its closed condition by the system water pressure. A drop in the system water pressure, as applied to the plunger of the check valve, results in movement of the plunger to release the clapper latch.

SUMMARY OF THE INVENTION

The actuator of the present invention is designed to rapidly reduce the water pressure which is applied to the check valve plunger upon the occurrence of an air pressure drop occasioned by the thermally responsive opening of one or more of the sprinkler heads.

Two illustrative embodiments of the present invention are illustrated. In both embodiments, a chamber is provided which includes inlet and outlet water openings. The inlet water opening is connected to the system water pressure line which is in common with the water pressure line connection to the water pressure activated plunger release mechanism of the check valve. The outlet opening of the actuator chamber is connected to a drain. The inlet and outlet openings of this actuator chamber are normally separated by a seal. While the seal is maintained, communication is blocked between the inlet and outlet openings of this actuator chamber. Upon the release of the seal, water line access will then be provided between the inlet and outlet water openings of the actuator. This results in a drop of water pressure within the plunger assembly of the check value, resulting in the activation of the plunger to release the check valve latch, which results in the movement of the check valve clapper to its open condition.

The opening of the water seal between the water inlet and outlet openings of the actuator results from the sensing of a differential pressure condition within the actuator which may be independent of the actual pressure differential being applied to the check valve clapper. More specifically, the actuator of the present invention includes a first chamber, having an inlet which is connected to the system air pressure. A partition wall is provided between the first chamber and an adjacent chamber of the actuator. According to one embodiment of the actuator, the adjacent chamber includes the inlet opening to the system water pressure, and an outlet opening to a drain. The partition wall includes a moveable pressure seal. The seal includes an air pressure seal which is subjected to the air system pressure within the first actuator chamber, and a water pressure seal which is subjected to the system water pressure in the adjacent chamber. The air pressure seal is preferably of the rolling diaphragm variety. The air pressure seal has a substantially greater area than the water pressure seal. This may typically be in the order of 8:1. When the pressure being applied over the areas of air and water pressure seals are in equilibrium, these seals will be in a first operative condition. Should there be a reduction in the system air pressure, resulting from the opening of one or more of the sprinkler heads, once a predetermined air pressure drop has occurred within the first chamber, the air pressure seal will no longer be in equilibrium with the water pressure seal. That seal will then be flexed towards the first chamber and move to a second operative condition. When this occurs the seal between the inlet and outlet openings of the water chamber will open, no longer blocking the communication between the inlet and outlet openings. This will then allow the system water pressure from the line in common with the check valve plunger to drain. The check valve is then rapidly operated to its open condition.

In accordance with another advantageous feature of the present invention, the air chamber has an additional opening which is normally maintained in its closed condition. However, upon actuation of the unit responsive to the drop in system air pressure, this additional outlet in the first chamber is also opened. This permits the rapid expulsion of air, and any water which may have entered the first chamber, thereby enhancing the speed of actuator operation. Typically, the normal air pressure in the dry fire control system may be in the order of 25 psi, with the water pressure being in the order of 80 psi. Should the air pressure drop to just below 10 psi, occasioned by the thermally actuated opening of one or more sprinkler heads, and there be an 8:1 ratio between areas of the air and water seals, the partition wall seal will then open, resulting in the simultaneous opening of the two additional seals within the actuator unit: (1) the water seal between the inlet and outlet openings of the water chamber, and (2) the air exhaust seal within the first chamber.

A modified embodiment of the actuator is also disclosed which can provide even more rapid operation in response to a drop in the system air pressure, occasioned by the opening of one or more sprinkler heads. An intermediate chamber is located between the first chamber and water chamber. The partition wall, and hence its seal, is now located between the first chamber and the intermediate chamber. The system air is simultaneously applied to both the first and intermediate chambers. However, a restrictor is provided between the input into the intermediate chamber and the chamber itself. When a drop in the system air pressure occurs, the intermediate chamber will have a slower drop off of its internal air pressure than the first chamber. Accordingly, an air pressure differential will exist between the intermediate and first chambers, with the differential being a function of the rate of the system air pressure drop, rather than the actual magnitude of system air pressure drop. When the air pressure differential between the first and intermediate chambers reaches a predetermined magnitude, there will be movement of the seal between the first and intermediate chambers to its second operative condition. The seal within the air exhaust opening of the first chamber will open, allowing for the rapid expulsion of the air within the first chamber. When this occurs the seal within the water chamber will also open, reducing the water pressure applied to the piston within the plunger assembly of the check valve.

Upon the opening of one or more sprinkler heads the system air pressure might typically drop in the order of 10 psi per minute. In the activator which includes the intermediate chamber, the air pressure within the first chamber will still be reduced by approximately 10 psi per minute. However, the air pressure in the intermediate chamber, because of the presence of the restrictor, will be reduced at a much slower rate. Typically, the requisite pressure differential between the first and intermediate chambers to operate the air pressure seal at the partition wall will result in the water seal in the water chamber being opened within 30 seconds.

It is therefore primary object of the present invention to provide an improved actuator for a differential check valve.

Another object of the present invention is to provide such an actuator which has a high differential seal.

A further object is to provide such an actuator in which the high differential seal senses the difference between the system air and water pressure.

Yet another object of the present invention is to provide such an actuator which operates in response to the rate of system air pressure drop upon the opening of one or more sprinkler heads.

Yet another object of the present invention is to provide such an actuator which operates in conjunction with a water piston activated latch release of check valve, to reduce the water pressure within the piston upon operation of the actuator.

Yet an additional object of the present invention is to provide a dry sprinkler actuator which operates in response to a drop in system air pressure, and provides for evacuation of the air within the actuator to enhance its speed of operation.

Yet a further object is to provide an integral actuator mechanism which provides a fast response to the check valve and prevents air and water buildup in the actuator.

These as well as other objects of the present invention will become apparent upon a consideration of the following detailed description and drawings.

BRIEF DESCRIPTION OF THE DRAWINGS

FIG. 3 is an enlarged view, showing the clapper and seal construction in the closed condition of FIG. 1.

FIG. 6 is a cross-sectional view of another form of the actuator of the present invention, shown in the closed condition.

FIG. 7 is a top view, partially cut away, of the actuator shown in FIG. 6.

DETAILED DESCRIPTION OF PREFERRED EMBODIMENT

Figure 1:
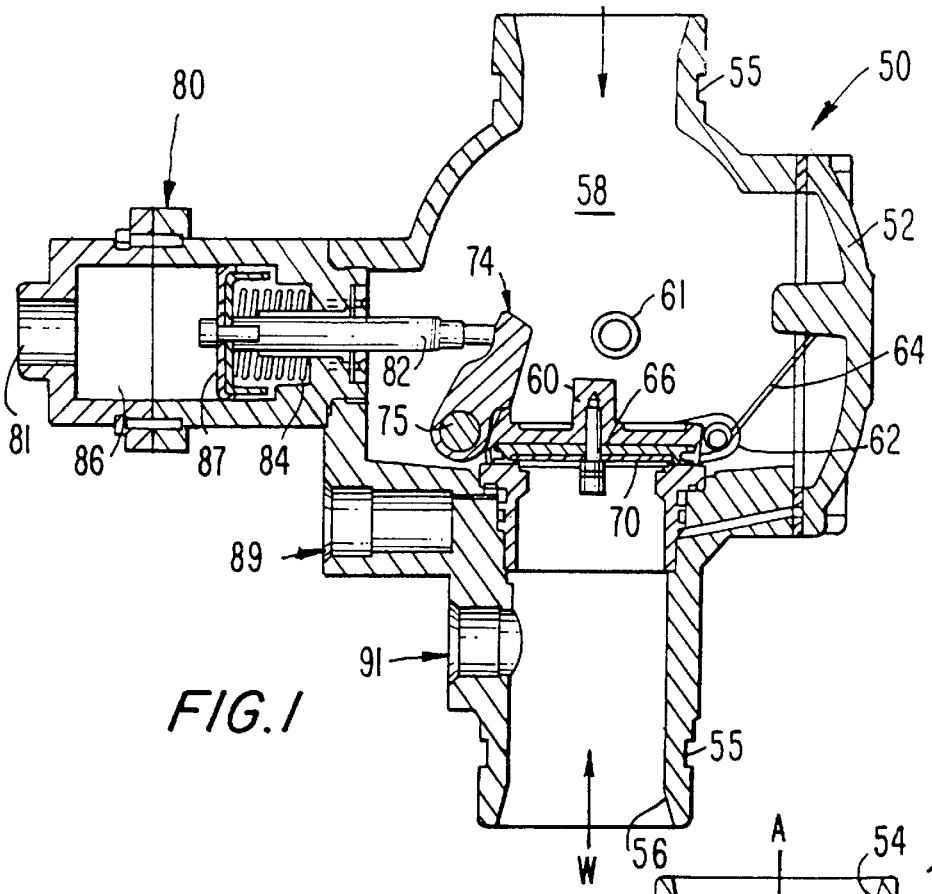
FIG. 1 is a cross-sectional view of a check valve which may be used in conjunction with the present invention, shown in the closed condition.
Figure 2:
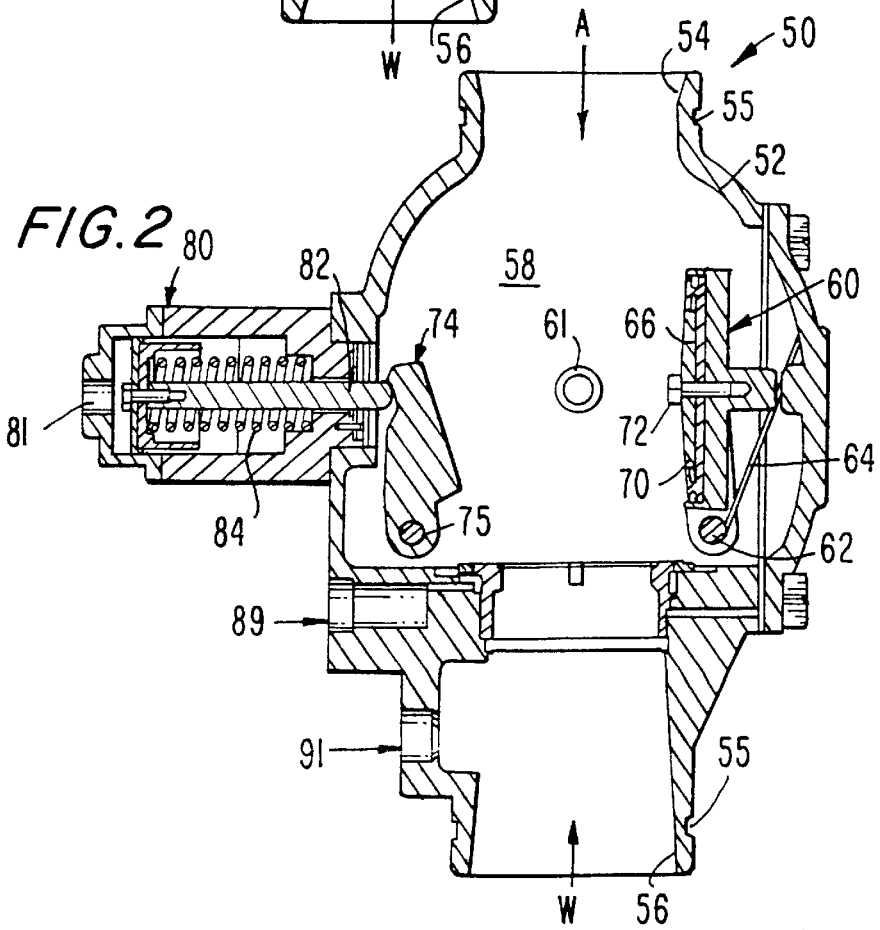
FIG. 2 is a cross-sectional view corresponding to FIG. 1, but showing the check valve in the open condition.

Reference is initially made to FIGS. 1-3 which show a form of the check valve which may be utilized with the actuator of the present invention. The check valve 50 is contained within a housing 52. The housing is constructed of a high strength metallic material, which may be ductile iron. However, it should be understood that other materials and processes of manufacture can be used. For instance the housing 52 could be constructed of machined stainless steel or suitably molded plastic or other materials having the requisite strength. Inlet 61 is connected to the system pressurized air (or other inert gas). The housing 52 includes an outlet 54 which is adapted to be connected to the sprinkler system piping. An inlet 56 at the opposite end of the housing is adapted to be connected to the source W of pressurized water. Both ends preferably include a groove 55 which is adapted to be connected to a coupling, or a flange (not shown), in the well known manner. Such couplings are typically available from Victaulic Company of America, Easton, Pa. A chamber 58 is provided between the opposed inlets 54–56. A clapper 60 is pivotally mounted at 62 and biased by spring member 64. When the clapper 60 is in the closed condition, as shown in FIG. 1 it serves to isolate the pressurized water W from internal chamber 58, and the sprinkler system piping which will be connected to upper inlet 54.

The clapper 60, which is preferably constructed of a metallic material, such as an aluminum-bronze alloy, has an associated low differential sealing structure. The sealing structure includes a flexible seal 66, preferably formed of rubber, a seal ring 68, which is preferably formed of a rigid plastic material, such as Delrin, and metallic seal plate 70, which may be formed of the same material as clapper 60. The diaphragm 66, sealing ring 68 and seal plate 70 are secured together by bolt 72, with intermediate washer 71 which mates with an internally threaded central aperture of the clapper 60. As shown in FIG. 1, the clapper 60 is maintained in its closed operative condition by a latch 74 which is pivoted about 75. The latch 74 is maintained in its latched condition by the piston assembly generally shown as 80. The piston assembly 80 includes a shaft 82 which is normally maintained in the position shown in FIG. 1, against the biasing force of expansion spring 84, by the system water pressure within its chamber 86 acting against head 87 of the piston assembly. The loss of the system air pressure within the fire sprinkler piping is, occasioned by the thermal actuation of sprinkler heads, when this occurs water will flow out of piston assembly chamber 86. This permits the shaft 82 of the piston assembly to move to the condition shown in FIG. 2. More specifically with the reduction of water pressure within chamber 86 the spring 84 moves the piston 82 resulting in the release of the latch 74. This allows the clapper 60 to move to its open operative condition about its pivot 62, as shown in FIG. 2. The depletion of the water within chamber 86 in response to the opening of sprinkler heads is accomplished by the actuator of the present invention. Two forms of actuator are shown in FIGS. 4–5 and 6–7 and will subsequently be described.

Referring back to the water and air pressure seals provided within the clapper 60 of the check valve, FIG. 3 shows that portion of the clapper structure in greater detail. Diaphragm 66 establishes two, radially proximate seals in association with the rigid platform 61 of the check valve housing 52. The pressurized air seal is provided by outermost flap 63 of the diaphragm which includes an upper surface 65 and lower surface 67. The pressurized air presented to the chamber 58 by the check valve inlet 61 is communicated to the narrow gap between the upper diaphragm surface 65 and seal retainer 68. This urges the flap 63 downward against an annular ridge 69 provided in the rigid platform 61. The water seal is provided by a downwardly projecting diaphragm ridge 73 which is at the inner extent of flap 63. The water pressure is applied against the upper surface 75 of the downwardly projecting ridge 73 to urge the ridge 73 in contact with a planer portion of the rigid platform 61 to provide the annular water seal. The annular air and water pressure seals preferably straddle a series of circumferentially spaced atmospheric openings 88. When the clapper moves to its open operative condition, with the diaphragm seals being defeated, the system water pressure will also flow through openings 88 which are in communication with alarm outlet 89. Water then flows out of alarm outlet 89 through a conventional type of water responsive signal means (not shown), typically referred to as a water motor alarm, which will provide an audible signal that the clapper has moved to its open operative condition as a result of the thermally responsive activation of the sprinkler system. An alarm test opening 91 is also provided in check valve 50. In the well known manner water is applied to alarm test opening 91 to actuate the alarm.

Accordingly, by virtue of this minimal separation between the air and water pressure seals of the low differential check valve, and the flexibility of the low seals, that seal is able to advantageously adjust for greater tolerance variations than previously allowed, and permit some degree of clapper movement, which may be occasioned by variations in the system air and water pressure, while still maintaining the seals, and not resulting in movement of the clapper to its open operative condition. The clapper moves to the open operative condition of FIG. 2 only upon the release of the latch 74 by the piston assembly 80.

Figure 8:
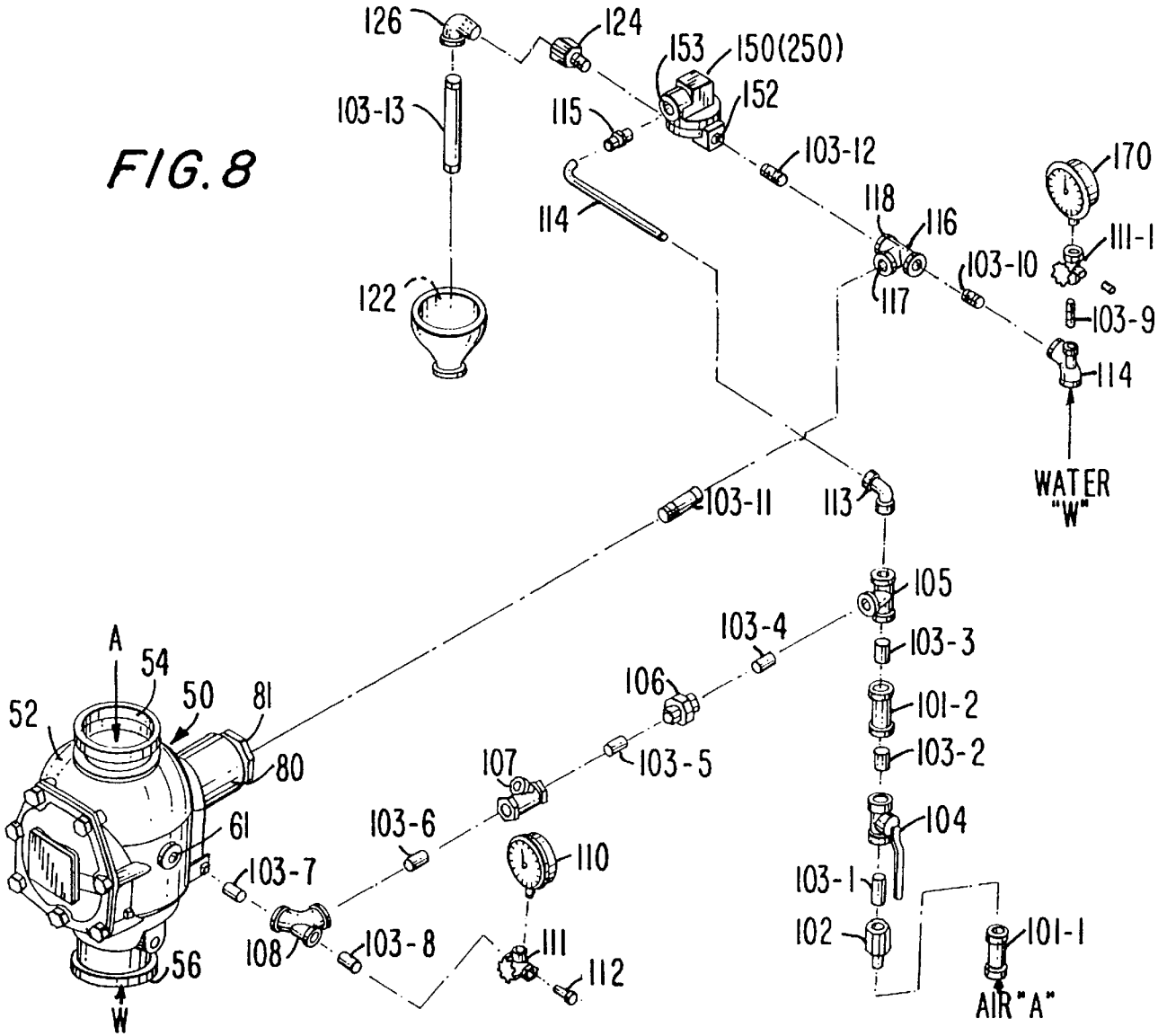
FIG. 8 is an exploded perspective view showing a portion of a typical dry fire control system utilizing the actuator of the present invention.

As shown in FIG. 8, the low differential check valve 50 is connected to both the system air source A, (which is also connected to the sprinkler piping (not shown)) and system water pressure source W presented to its inlets 54, 56. The air pressure A is also typically connected to the inlet 61 of the check valve via connector 101-1 restrictor 102, nipple 103-1, ball valve 104, nipple 103-2, connector 101-2, nipple 103-3 TEE, nipple 103-3, TEE connector 105, nipple 103-4, union 106, nipple 103-5, wing check valve 107, nipple 103-6, reducing TEE 108 and nipple 103-7. A supervisory switch not shown, may also be connected to an additional arm of connector 105. An air pressure gauge 110 is preferably also connected to reducing TEE 108 via nipple 103-8, and TEE valve 111, with plug 112 being inserted in the terminus of the air pressure gauge line.

The air pressure gauge line is also simultaneously connected to input 153 of the actuator 150 or 250, of the present invention, via elbow 113, tubing 114 and a compression fitting 115.

The system water pressure W is also simultaneously connected to both the check valve 50 and actuator 150 (or 250). The water pressure W flows through reducing TEE 114 with one of its arms going to water pressure gage 120 via nipple 103-9 and TEE valve 111-1. The other arm of the reducing TEE 114 is connected to TEE member 116 via nipple 103-10. One of the arms 117 is then connected to piston assembly inlet 81 of the low differential check valve, via nipple 103-11. The other arm 118 of the TEE connector 116 is connected to system water inlet 152 of the actuator 150 or 250 via nipple 103-12. As will subsequently be explained, the actuator 150 or 250 also includes a connection to drain 122 which is shown via restrictor 124 elbow 126 and nipple 103-13. It should naturally be understood that the system connection shown in FIG. 8 is merely illustrative of a typical use of the low differential check valve 50 of the present invention and is not intended to be limiting.

Figure 5:
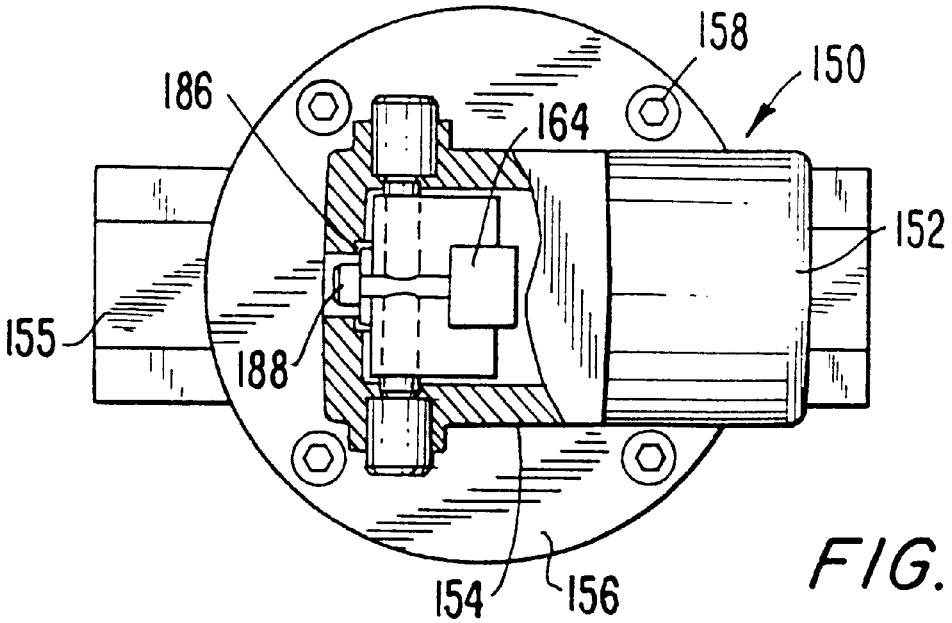
FIG. 5 is a top view, partially cut away, of the actuator shown in FIG. 4.
Figure 4:
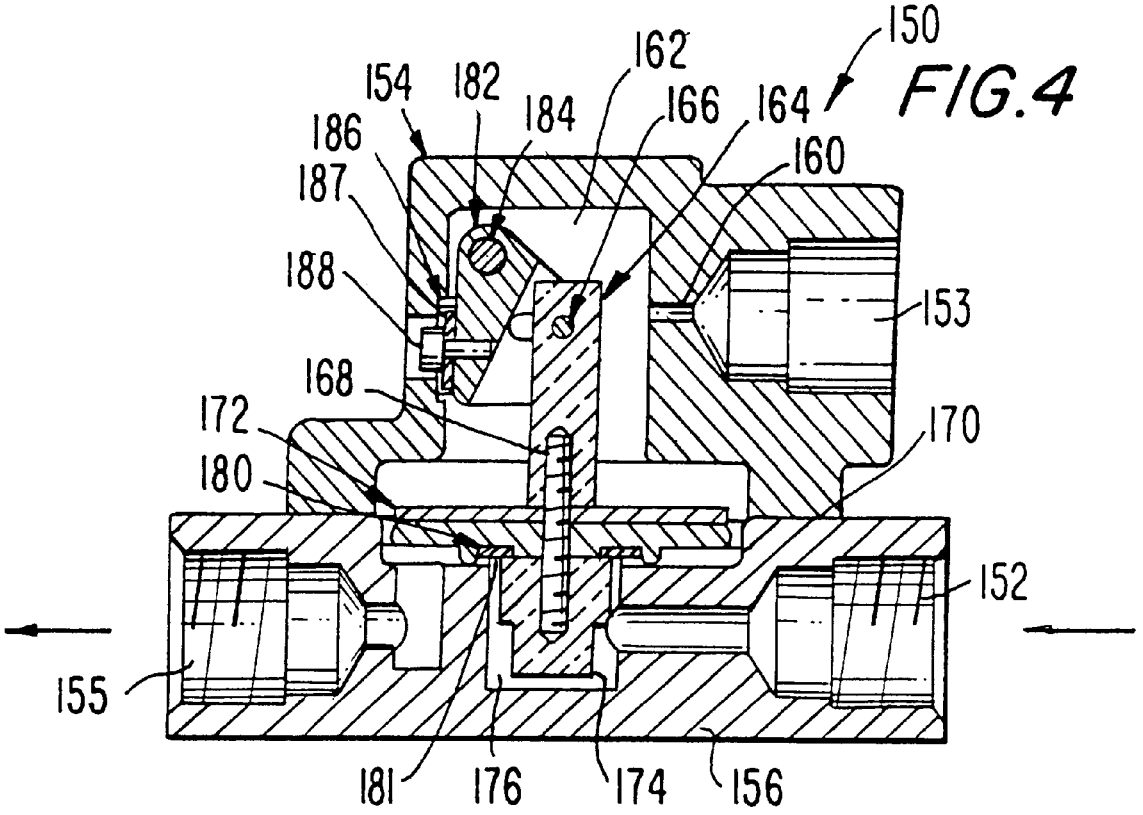
FIG. 4 is a cross-sectional view of one form of the actuator of the present invention, shown in the closed condition.

Reference is now made to FIGS. 4 and 5 which show one form of the actuator 150, of the present invention. The actuator 150, which will be of substantially lesser size then the differential check valve 50, includes two-part housing 154, 156 connected by a plurality of bolts 158. The system air pressure at inlet 153 (See also FIG. 8) is presented through narrowed opening 160 to chamber 162. A vertically movable actuator shaft 164 is provided with an actuator pin 166 and a threaded rod 168 for receiving a diaphragm assembly 170 having a diaphragm retainer 172 at one side thereof. A dry actuator seal retainer 174 is at the lower most extent of the actuator pin 166. The system water pressure inlet 152 communicates with a lower chamber 176. The upper end of chamber 176 faces seal 180 which provides a water seal between the dry seal actuator retainer 174 and projection 181 of the lower housing section 156. The air seal is provided by diaphragm 170, which will preferably be of the rolling diaphragm variety.

It should be readily appreciated that the air seal is provided over a substantially greater area than the water seal. This may typically be in the order of 8:1. Thus with this ratio, 1 psi of air will be an equilibrium with 8 psi of water. Should there be a reduction in the air pressure, the actuator shaft 164 will rapidly move upward, with the differential pressure over the areas of the opposed seals being equal to the difference in actual pressure multiplied by the ratio (e.g. 8:1) between the areas of the high differential air and water seals. As the shaft moves upward the dry actuator seal retainer 174 allows water inlet 152 to communicate with outlet 155 which will be connected to the drain 122, shown in FIG. 8. This results in the water pressure in the piston assembly 80 of the check valve (to which inlet 152 is also connected) to be rapidly reduced. This allows the piston 82 of the differential check valve to move to the condition shown in FIG. 2, releasing latch 74, which then results in the clapper in the check valve 50 moving to its open operative condition. Thus the combination of the high differential actuator 150, in conjunction with the low differential check valve 50 results in a substantially smaller check valve, at a location away from the check valve differential seal, sensing the differential pressure, resulting from the actuation of a sprinkler head.

To further speed the operation of the actuator 150, as actuator shaft 164 moves upward it engages cam 182 which is mounted on shaft 184. The rotation of cam 182 permits the opening of the upper chamber seal 186 which is connected to cam 182 by self tapping capscrew 188, with intermediate washer 187. The opening of the seal 186 will allow the air within the upper chamber 162, and any water which may enter chamber 162 to be rapidly expelled.

A particularly advantageous aspect of the differential actuator shown in FIGS. 4 and 5 is that it will be rapidly opened as soon as there is a slight change in the equilibrium between the applied air and water forces, to provide anti-flutter operation. This is to be contrasted to prior art dry actuators which experienced a tendency to open and close when subjected to slight variations in the air and water pressure which are insufficient to actuate the typical prior art valve. Further, such flutter would permit additional water to flow on the air side of the check valve, resulting in a water column which disadvantageously affects future operation and reliability of the check valve.

The opening of the upper chamber seal 186 advantageously prevents the reclosure once shaft 164 has been activated to engage cam 182, it being understood that when actuator 150 has been engaged pressurized air is still being applied to the system. Should the air pressure equalize the water force, actuator 150 could reclose. The opening of seal 186 also advantageously allows any water which may enter upper chamber 162 to be expelled. This will prevent water which would enter the upper chamber 162 upon operation of the actuator 150 from flowing into the air lines and possible incorrectly resetting diaphragm 170.

In a typical operation of the actuator unit shown in 150 their will be an 8:1 ratio between the area of the air seal and water seal. Accordingly, the unit will remain in the closed condition as shown in FIG. 4 as long as the air pressure does not drop to ⅛ of the water pressure. Typically, the air pressure in the non-activated dry fire control system will be in the order of 25 psi, with the system water pressure being in the order of 80 psi. Should the air pressure drop to just below 10 psi, occasioned by the thermally actuated opening of one or more sprinkler heads, there will be rapid movement of the seal 170–180 between chambers 162, 176 towards chamber 162. This movement of the seal, to its second operative condition, moves the actuator shaft 164 upward, with the result that actuator unit 150 will then be in its open condition. This will open the passage between inlet 152 from the plunger assembly 80 of the dry actuator check valve, and outlet 155 to the drain 122. The draining of water from the chamber 86 of the assembly 80, results in its output shaft 82 moving to the condition shown in FIG. 2, thereby releasing the clapper latch 74, allowing clapper 60 to move to the open condition, with the result that the system water pressure is then applied to the piping system through the open sprinkler. The activation of the plunger assembly by controlling the water pressure in its chamber 86 advantageously provides more rapid operation than prior art systems which utilize air pressure as the control.

Reference is now made to FIGS. 6 and 7 which show an alternative embodiment 250 of the actuator shown in FIGS. 4 and 5. Those components that correspond to like components of the embodiment shown in FIGS. 4 and 5 are similarly numbered. Actuator 250 can provide even faster speed that actuator 150. When utilized in dry sprinkler control system as shown in FIG. 8, actuator 250 will be substituted for actuator 150, as indicated by the (250) in FIG. 8.

The actuator unit shown in FIGS. 6 and 7 differs from the aforedescribed unit shown in FIGS. 4 and 5 in that it includes an intermediate housing 252 which has an intermediate chamber 254. As will subsequently be explained, this actuator is responsive to the rate of the system air pressure drop, rather than the actual magnitude of the pressure drop. It has been determined that in those situations that increased speed of operation is required, actuator 250 can be designed to increase the speed that the lower chamber seal 174 is opened, thereby permitting the flow of water between openings 152, 155 which, as described above reduces the water pressure within plunger 80 of the check valve. This results in the opening of the check valve 50.

It is to be noted that seal 174 of actuator 250 is somewhat modified with respect to seal 174 of actuator 150. There is a seal retainer 174-1, which secures the seal 174 to the lower shaft portion 256 of the actuator assembly. A spring energized seal 258 is preferably provided between the lower shaft 256 and intermediate shaft 260 of the actuator. An annular gasket 262 is provided at the juncture of lower housing member 171 and intermediate housing member 252.

The inlet opening 253 is connected to the system air pressure input, which would typically be by a Tee connector (not shown) in FIG. 8. The connection between inlet opening 253 and intermediate chamber 254 is through a restrictor assembly 265. The restrictor assembly includes a housing 273 for an air flow restrictor 266. Air flow restrictor 266 may typically be formed of stainless steel. It is located within check 268, which also includes expansion spring 270 and a seal 272.

The partition wall between the upper chamber housing 174 and intermediate chamber housing 252 includes the seal assembly 172 which has a rolling diaphragm 170, to provide an air seal to chamber 162, in the same manner as diaphragm 170 of the actuator shown in FIGS. 4 and 5. However, whereas the actuator of FIGS. 4 and 5 included a water seal in opposition to diaphragm seal 170, the actuator of 250 includes an air seal 274, which is subjected to the air pressure within the intermediate air chamber 254.

Considering now the operation of actuator 250, under normal conditions, with all the system sprinkler heads being closed, there will be equal pressure in chambers 162 and 254. Thus, seals 274 and 172 will both be in the equilibriam condiction, or first operative, shown in FIG. 6. If one or more of the sprinkler heads open, there will be a drop in the air pressure, which is simultaneously applied to inlets 153 and 253, resulting in the loss of air pressure in their respective chambers 162, 254. However, because of the restrictor 266, the drop of air pressure in intermediate chamber 254 will be at a slower rate than the drop of air pressure within chamber 162. Hence, as the air is more rapidly expelled, in upper chamber 162, the reduced air pressure in chamber 162, which is related to the acceleration of air pressure drop, will result in the upward movement of the diaphragm seal 170 to its second operative condition. The piston assembly 260 then moves up. This upward movement of the piston assembly results in both (1) the removal of the seal 174 between the water inlets and outlets 152, 155 of the lower chamber 171, and (2) opening of the seal 187 in the upper chamber, so as to then permit the rapid expansion of air there through.

While not intended to be limiting, the following dimensions are representative of the central portions of the seals shown in the above described embodiments:

Actuator 150

Air Pressure Seal 170 1.25 cm

Water Pressure Seal 180 0.625 cm

Actuator 250

Air Pressure Seal 170 2.5 cm

Air Pressure Seal 274 1.25 cm

The utilization of the actuator of the present invention will provide rapid and reliable operation of a dry check valve, of the type typically shown in a form in a U.S. patent application Ser. No. 09/080,879. Further, the coordation of the actuator of the present invention with the check valve permits a substantial reduction in the volume and weight of the check valve, while permitting an increase in its pressure rating.

While the present invention has been disclosed with reference to specific embodiments and particulars thereof, many variations should be apparent to those skilled in the art. Accordingly, it is intended that the invention be described by the following claims.

What is claimed is:

1. A dry sprinkler actuator comprising:

a housing including at least first and second chambers, with a partition wall between said first and second chambers;

a first seal within said partition wall, said first seal including opposed sealing means, and having a first condition corresponding to the presence of a pressure equilibrium condition at said first seal, and a second condition corresponding to the presence of a predetermined pressure differential between said opposed sealing means at said first seal;

said first chamber further including an outlet opening, and a second seal for said outlet opening, said second seal normally being in a closed condition for sealing said outlet opening;

a first connection means between said first and second seals for maintaining said second seal in its closed condition, when said first seal is in its first condition, and opening said second seal when said first seal moves to its second condition, whereby the presence of a predetermined pressure differential between said opposed sealing means at said first seal also opens said second seal, the opening of said second seal allowing evacuation of said first chamber through said outlet opening;

said second chamber including an inlet opening connected to a sprinkler system pressurized water source, an outlet opening communicating with said inlet opening, and a third seal intermediate said inlet and outlet openings, said third seal normally being in a closed condition for preventing communication between the inlet and outlet openings of said second chamber;

a second connection means between said first and third seals, said second connection means having a first condition corresponding to said first seal being in its first condition, and a second position corresponding to said first seal being in its second condition whereby the movement of said first seal to its second condition moves said third seal to its open condition, the movement of said third seal to its open condition permitting communication between the inlet and outlet openings of said second chamber, to permit the flow of the system water between said inlet and outlet openings.

2. A dry sprinkler system actuator claim 1: wherein:

said first and second connection means are provided by a unitary piston which is connected to, and actuated by, the movement of said first seal.

3. A dry sprinkler system actuator of claim 1, wherein said first seal opposed sealing means includes an air pressure air seal between said first and second chambers which is subjected to the air pressure within said first chamber, and a water pressure seal between said first and second chambers which is subjected to the water pressure within said second chamber, said air pressure seal extending over a substantially greater area than said water pressure seal;

said first seal first condition characterized as said water and air pressure seals at said first seal being in an equilibrium condition, said first seal second condition characterized as said water and air pressure seals at said first seal being in a non-equilibrium condition with a predetermined differential pressure being applied by the water pressure in said second chamber against said water pressure seal which is in excess of the air pressure applied in said first chamber against said air pressure seal to open said first seal.

4. A dry sprinkler system actuator of claim 3 wherein the differential area between said air and water pressure seals in the order of 8:1.

5. A dry sprinkler system actuator of claim 1, wherein said first and second connection means are provided by a piston connected to said first seal, said piston movable between a first position, when said first seal is in its first condition, and a second position when said first seal is in its second condition; and said second seal and third seals are connected to said piston.

6. A dry sprinkler system actuator of claim 5, wherein said piston including a shaft extending into said first chamber, a cam between said shaft and said second seal, the movement of said piston to its second position providing camming engagement between said shaft and cam to open said second seal.

7. A dry sprinkler system actuator of claim 3, wherein said air pressure seal includes a rolling diaphragm.

8. A dry sprinkler system actuator of claim 1, further including an intermediate chamber between said first and second chamber;

said intermediate chamber including an inlet opening adapted to be connected to the sprinkler system air source, and an air restrictor between said inlet opening and intermediate chamber;

said first seal located between said first and intermediate chambers, and said opposed sealing means including first and second air pressure seals, the air pressure within said first chamber applied to said first air pressure seal, and the air pressure within said intermediate chamber applied to said second air pressure seal;

said opposed sealing means being maintained in a first condition when said first and second air pressure seals are in equilibrium;

said air restrictor delaying the exhaustion of air from, and drop of air pressure within, said intermediate chamber in response to a reduction in the system air pressure being applied to said first and intermediate chambers, said intermediate chamber retaining a higher pressure than said first chamber during an initial drop in the system air pressure, whereby the differential air pressure within said first and intermediate chambers is operatively related to the speed of system air pressure drop;

said opposed sealing means responding to a predetermined air pressure differential between said first and intermediate chambers to move to its second condition.

9. A dry sprinkler actuator of claim 1, wherein the predetermined differential pressure between said opposed sealing means at said first seal maintains said first seal in said second condition devoid of any manually releasable latch mechanism.

10. A dry sprinkler actuator of claim 3, wherein the predetermined differential pressure between said water and air pressure seals at said first seal maintains said first seal in said second condition devoid of any manually releasable latch mechanism.

11. A dry sprinkler actuator of claim 8, wherein the predetermined differential pressure between said opposed sealing means at said first seal maintains said first seal in said second condition devoid of any manually releasable latch mechanism.

12. A dry sprinkler system actuator comprising:

a housing including a first chamber having an inlet opening, an outlet opening, a first sealing means on a partition wall away from said inlet and outlet openings and releaseable second sealing means for sealing said outlet opening, said inlet opening adapted to be connected to the sprinkler system air source;

a second chamber extending from the partition wall of said first chamber, said second chamber including an inlet opening connected to the sprinkler system pressurized water source, an outlet opening communicating with said inlet opening and a third sealing means between said inlet and outlet openings;

said first sealing means including an air pressure seal on the first chamber side between said first and second chambers, and a water pressure seal on the second chamber side between said first and second chambers, said air pressure seal extending over a substantially greater area than said water pressure seal;

said water and air pressure seals being in an equilibrium first condition when equal pressures are applied thereto, said air and water pressure seals being in a second condition upon a predetermined differential pressure existing between said water seal in excess of the pressure applied to said air pressure seal; and said first and third seals being operatively connected, such that the movement of said first seal to its second condition opens said third seal to permit communication between said second chamber inlet and outlet openings, whereby the water presented to said second chamber inlet opening flows into and out of said second chamber outlet opening.

13. A dry sprinkler system actuator of claim 12, further including a linkage between the outlet opening of said first chamber and said first sealing means;

said linkage having a first position corresponding to said air and water pressure seals being in their first condition, and a second position corresponding to said air and water pressure seals being in their second condition;

said linkage first position maintaining the seal of said first chamber outlet, and said second position releasing the seal of said first chamber outlet to open said outlet, said opened outlet permitting the expulsion of the system air within said first chamber.

14. A dry sprinkler system actuator of claim 12 wherein the differential area between said air and water pressure seals is in the order of 8:1.

15. A dry sprinkler system actuator of claim 12, wherein said air and water pressure seals are carried by a piston, which is movable between a first position when said first sealing means is in its first condition, and second position when said first sealing means is in its second condition; and said third sealing means is connected to said piston.

16. A dry sprinkler system actuator of claim 15, wherein said piston includes a shaft extending into said first chamber, a cam between said shaft and said first chamber seal, the movement of said piston to its second position providing camming engagement between said shaft and cam to open said first chamber seal.

17. A dry sprinkler actuator of claim 12, wherein the predetermined differential pressure between said water and air pressure seals at said first seal maintains said first seal in said second condition devoid of any manually releasable latch mechanism.

18. A dry sprinkler system actuator comprising:

a housing including a first chamber having an inlet opening, an outlet opening, a first sealing means on a partition wall away from said inlet and outlet openings, and releasable second sealing means for sealing said outlet opening, said inlet opening adapted to be connected to the sprinkler system air source;

an intermediate chamber extending from said partition wall of said first chamber and having opposed first and second sides, with said first sealing means being between said first side and said first chamber, said first sealing means being responsive to the pressures in said first and intermediate chambers;

a second chamber extending from said second side of said intermediate chamber, said second chamber including an inlet opening connected to the sprinkler system pressurized water source, an outlet opening communicating with said inlet opening, and a third sealing means between said inlet and outlet openings;

said intermediate chamber including an inlet opening adapted to be connected to the sprinkler system air source, and an air restrictor between said inlet opening and intermediate chamber;

said first sealing means including a first and second air pressure seal, the air pressure within said first chamber being applied against said first air pressure seal, and the air pressure within said intermediate chamber being applied against said second air pressure seal;

said first sealing means normally being in first equilibrium condition and moving to a second condition responsive to a predetermined air pressure differential between said first and second air pressure seals;

said air restrictor delaying the exhaustion of air from, and drop of air pressure, within said intermediate chamber in response to a reduction in the system air pressure being applied to said first and intermediate chambers, said intermediate chamber having a higher pressure than said first chamber during an initial drop of the system air pressure, whereby the differential air pressure within said first and intermediate chamber is operatively related to the speed of system air pressure drop;

a first connection means between said first and third sealing means, whereby the movement of said first sealing means to its second condition opens said third sealing means to permit communication between said second chamber inlet and outlet openings, whereby the water presented to said second chamber inlet opening flows into said second chamber and out of said second chamber outlet opening.

19. A dry sprinkler system actuator of claim 18, further including:

a second connection means between the outlet opening of said first chamber and said first sealing means;

said second connection means having a first position corresponding to said first sealing means being in its first condition, and a second position corresponding to said first sealing means being in its second condition;

said first position of said second means maintaining said second seal of said first chamber outlet, and said second position of said second connection means releasing said second seal to open said first chamber outlet, said opened first chamber outlet permitting the expulsion of the system air within said first chamber.

20. A dry sprinkler system actuator of claim 18 wherein the differential area between said first and second air seals is in the order of 8:1, with said first air seal having the greater area.

21. A dry sprinkler actuator of claim 14, wherein the predetermined differential pressure between said first and second air pressure seals at said first sealing means maintains said first sealing means in said second condition devoid of any manually releasable latch mechanism.

* * * * *